United States Patent [19]

Anders

[11] Patent Number: 4,554,770

[45] Date of Patent: Nov. 26, 1985

[54] HORIZONTAL SLIDING WINDOW WITH REMOVABLE FIXED SASH

[75] Inventor: Dennis F. Anders, Lexington, N.C.

[73] Assignee: National Gypsum Company, Dallas, Tex.

[21] Appl. No.: 569,998

[22] Filed: Jan. 11, 1984

[51] Int. Cl.[4] ..... E05D 15/08

[52] U.S. Cl. ..... 52/207; 49/425; 49/404; 49/DIG. 1

[58] Field of Search ..... 52/207; 49/404, 406, 49/458, 207, 425, DIG. 1, DIG. 2

[56] References Cited

U.S. PATENT DOCUMENTS

| | | | |
|---|---|---|---|
| 3,324,597 | 6/1967 | Rich | 52/207 |
| 3,344,575 | 10/1967 | Grossman | 52/207 |
| 3,411,239 | 11/1968 | Grossman | 52/203 |
| 3,487,580 | 1/1970 | Holliday | 52/207 |
| 4,064,653 | 12/1977 | Randall et al. | 49/458 |
| 4,151,682 | 5/1979 | Schmidt | 49/458 |
| 4,202,137 | 5/1980 | Randall | 49/458 |
| 4,398,373 | 8/1983 | Mancuso | 52/207 |

FOREIGN PATENT DOCUMENTS

| | | | |
|---|---|---|---|
| 764212 | 8/1967 | Canada | 49/404 |

*Primary Examiner*—Donald G. Kelly
*Assistant Examiner*—Richard E. Chilcot, Jr.
*Attorney, Agent, or Firm*—Robert F. Hause

[57] ABSTRACT

A thermally insulating window having two spaced parallel removable sashes in side by side relation, closely spaced apart meeting rails on the sashes and an intermediate rail member sealing the space between the meeting rails.

20 Claims, 7 Drawing Figures

HORIZONTAL SLIDING WINDOW WITH REMOVABLE FIXED SASH

This invention relates to a fully sealed dual lite window with, side by side, a slidable sash and a fixed sash both of which are readily removable.

BACKGROUND OF THE INVENTION

Prior thermally insulated horizontal slider windows, having one fixed sash and one horizontally sliding sash, in which the frames are constructed with no direct metal heat-conducting path from the inner surface of a frame or sash member to the outer surface, if constructed to permit removal of the two sashes, had a small gap through which air could pass at the fixed sash meeting rail, to permit the fixed sash to be raised slightly during removal. To avoid drafts, occupants found it necessary to take special steps, each time the sashes were replaced in the frame, to seal this gap, as by stuffing material of a suitable nature into this gap.

SUMMARY OF THE INVENTION

The present invention consists of a horizontal slider window, with one fixed sash, one horizontally sliding sash and a separate intermediate interlock rail removably affixed to the fixed sash meeting rail. The interlock rail includes means for readily being removably affixed to the fixed sash meeting rail and extending completely from the frame sill to the frame head, avoiding any gaps through which air might pass, heretofore created by notching the meeting rails at the top to permit raising the sash during removal.

The meeting rails on the fixed sash and the vent sash may still need to be notched in order to assemble the window of the invention, and this notching may leave a gap between the end of a portion of the meeting rail and the frame head; however, in accordance with the invention, the interlock rail will provide a seal, preventing air leakage through such a gap.

The intermediate interlock rail, which engages the sash meeting rails, is constructed in a manner which avoids a direct metal heat-conducting path from the inner surface to the outer surface.

It is an object to provide a multiple sash window, with sashes side by side, in which the sashes are removable, and a seal is provided between the adjacent sashes by a separate removable intermediate interlocking rail.

It is a further object of the present invention to provide a horizontal slider window having removable sash which is completely thermally insulated and sealed.

BRIEF DESCRIPTION OF THE DRAWINGS

These and other objects and advantages of the invention will be more readily apparent when considered in relation to the preferred embodiment as set forth in the specification and shown in the drawings in which.

DESCRIPTION OF THE PREFERRED EMBODIMENT

Figure 1:
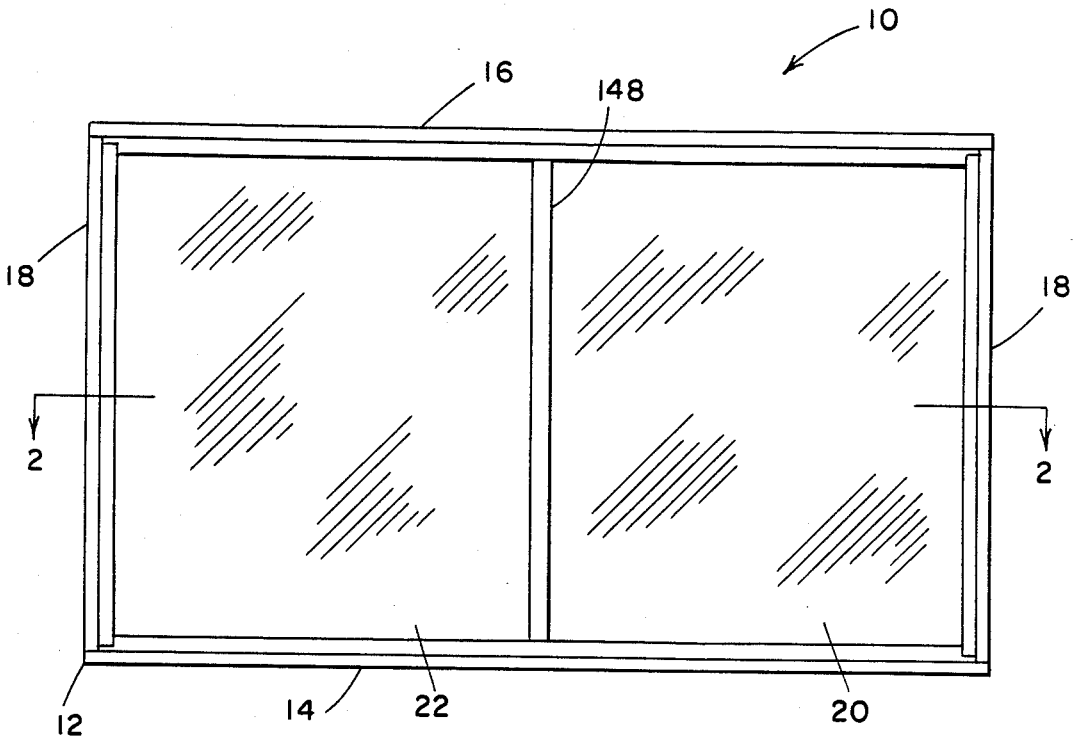
FIG. 1 is a front elevational view of a window made in accordance with the invention.

Referring to FIG. 1, there is shown a window 10, suitable for mounting in an opening in a building. If made tall enough, window 10 could function also as a door. The window 10 includes a frame 12 including a horizontal sill member 14, a horizontal head member 16, and a pair of vertical jamb members 18, 18. The frame 12 forms an opening therewithin in which there are disposed a right, fixed, outer sash 20 and a left horizontally slidable inner vent sash 22.

In accordance with the invention, an intermediate interlock rail 24 is vertically disposed between the overlapping portions of the two sashes 20, 22.

Each sash 20, 22 has a pair of spaced glass sheets 26 mounted in suitable channels 28 containing glazing vinyl strips 30.

The frame 12, the sashes 20, 22 and the interlock rail 24 are formed primarily of aluminum extrusions designed to coact when assembled, as herein disclosed, to provide a completed window of improved characteristics.

The frame 12 includes protruding mounting strips 32 extending outwardly about one to two inches in all four directions for engaging the wall of a building around the opening in the wall.

In addition to the upwardly extending mounting strip 32, the head member 16 includes a directly connected, outwardly extending, cross member 34, an indirectly connected, inwardly extending, cross member 36 and an elongate, plastic thermal break 38 connecting the indirectly connected portions 32 and 36.

Extending downwardly below cross members 34, 36, at about the center of the head member, is an elongate flange 40 having along the bottom, in cross section, a barb section 44. The barb section 44 is disposed within an upwardly opening channel 46 of an elongate frame head parting-vinyl rigid strip 48. Rigid strip 48 has, in cross section, an oppositely disposed barb section 50 which engages barb section 44, holding rigid strip 48 in place. Rigid strip 48 forms a non-metallic central wall for each of two top channels 52 and 54, having respective outer walls 56 and 58 extending downwardly from, respectively, cross members 34 and 36.

Top channels 52 and 54 are of sufficient width to retain in a sealing relationship the top members 60 and 62 of, respectively, outer sash 20 and inner sash 22, and of sufficient depth to permit removal of the sashes 20, 22 by raising the sash top members 60 and 62 up into the channels 52 and 54.

Rigid strip 48 has an elongate flat bottom wall 64 connecting the two upwardly extending flanges 66 and 68 which provide the two central walls for each of the two channels 52 and 54.

In addition to the downwardly extending mounting strips 32, the sill member 14 includes a directly connected outwardly extending cross member 70, an indirectly connected, inwardly extending cross member 72 and an elongate, plastic thermal break 74 connecting the indirectly connected portions 32 and 72.

Extending upwardly above cross members 70, 72, at about the center of the sill member, is an elongate flange 76 having, along the top, in cross section, a barb section 80. The barb section 80 is disposed within a downwardly opening channel 82 of an elongate frame sill parting-vinyl rigid strip 84. Rigid strip 84 has, in cross section, an oppositely disposed barb section 86 which engages barb section 80, holding rigid strip 84 in place. Rigid strip 84 forms a non-metallic central wall for each of two bottom channels 88 and 90, having respective outer walls 92 and 94 extending upwardly from, respectively, cross members 70 and 72.

Bottom channels 88 and 90 are of sufficient width to retain in a sealing relationship the bottom members 96 and 98 of, respectively, outer sash 20 and inner sash 22.

Rigid strip 84 has an elongate flat top wall 100 connecting the two downwardly extending flanges 102 and 104 which provide the two central walls for each of the two channels 88 and 90. Rigid strip 84 also includes an outward flange 106 having an outer edge 108 resting on a ledge 110 on the inside of outer wall 92. Flange 106 functions as a false bottom in channel 88 whereby outer sash 20 needs only to be lifted up a short distance, raising the sash top member 60 only a short distance into channel 52, to remove the sash 20 inward over the flat top wall 100 and outer wall 94.

Four roller assemblies 112 are mounted in bottom channel 90, supporting slidable inner sash 22 and functioning as a false bottom in channel 90 whereby inner sash 22 needs only to be lifted up a short distance, raising the sash top member 62 only a short distance into channel 54, to remove sash 22 inward over the outer wall 94.

In addition to the outwardly extending mounting strip 32, each frame jamb 18 includes a directly connected outwardly extending cross member 114, an indirectly connected inwardly extending cross member 116 and an elongate plastic thermal break 118 connecting the indirectly connected portions 32 and 116.

Extending into the window area from cross members 114, 116, at about the center of the jamb, is an elongate frame jamb parting-vinyl rigid strip 120 having three outwardly directed short flanges 122, 124, 126. A first flange 122 is disposed firmly against the thermal break 118. The second flange 124 has, along the outer end, in cross section, a barb section 130. The second flange 124 and the third flange 126 have disposed between them an oppositely disposed barb section 132 which is on the base stem 134 of an elongate T-section 136. T-section 136 is adjoined to the outer end of outwardly extending cross member 114, and retains the rigid strip 120 in proper position. Rigid strip 120 forms a non-metallic central wall of channel 138, along with an outer wall 140 extending into the window area from the inner end of the indirectly connected inwardly extending cross member 116. Channel 138 of the left jamb 18, in FIG. 2, is formed to sealingly receive in the left jamb 18 of FIG. 2, the vent sash jamb 142 of the slidable inner vent sash 22.

A shallow channel 144 in the base stem 134 of the left jamb and a cooperative shallow channel 146 in the fixed sash meeting rail 148 are formed to receive and hold a window screen (not shown). The fixed sash meeting rail 148 also has an oppositely directed channel 28, which is one of the channels for holding glazing vinyl strips 30 and glass sheets 26.

Figure 2:
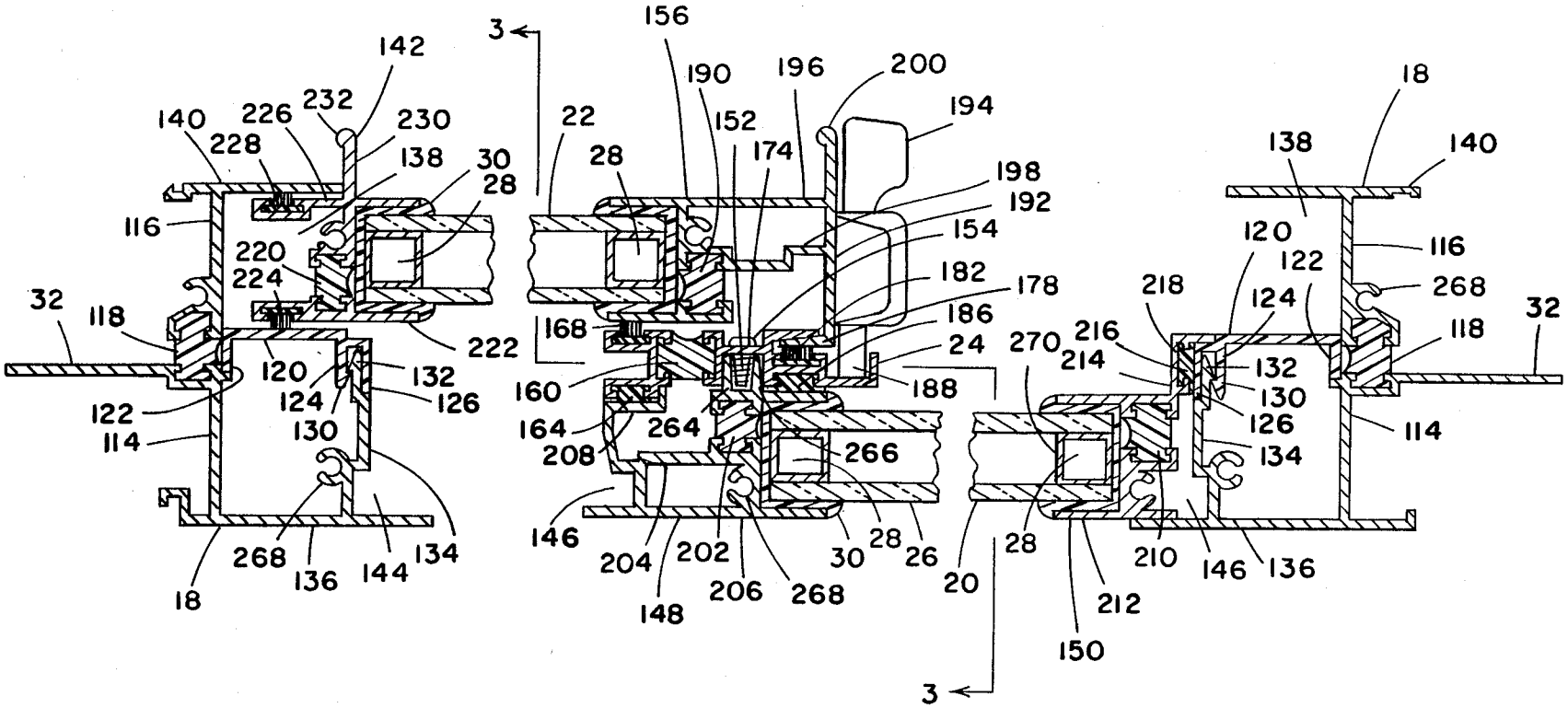
FIG. 2 is a cross-sectional view of the bottom half of the window of FIG. 1, with a section taken along line 2—2 of FIG. 1.
Figure 3:
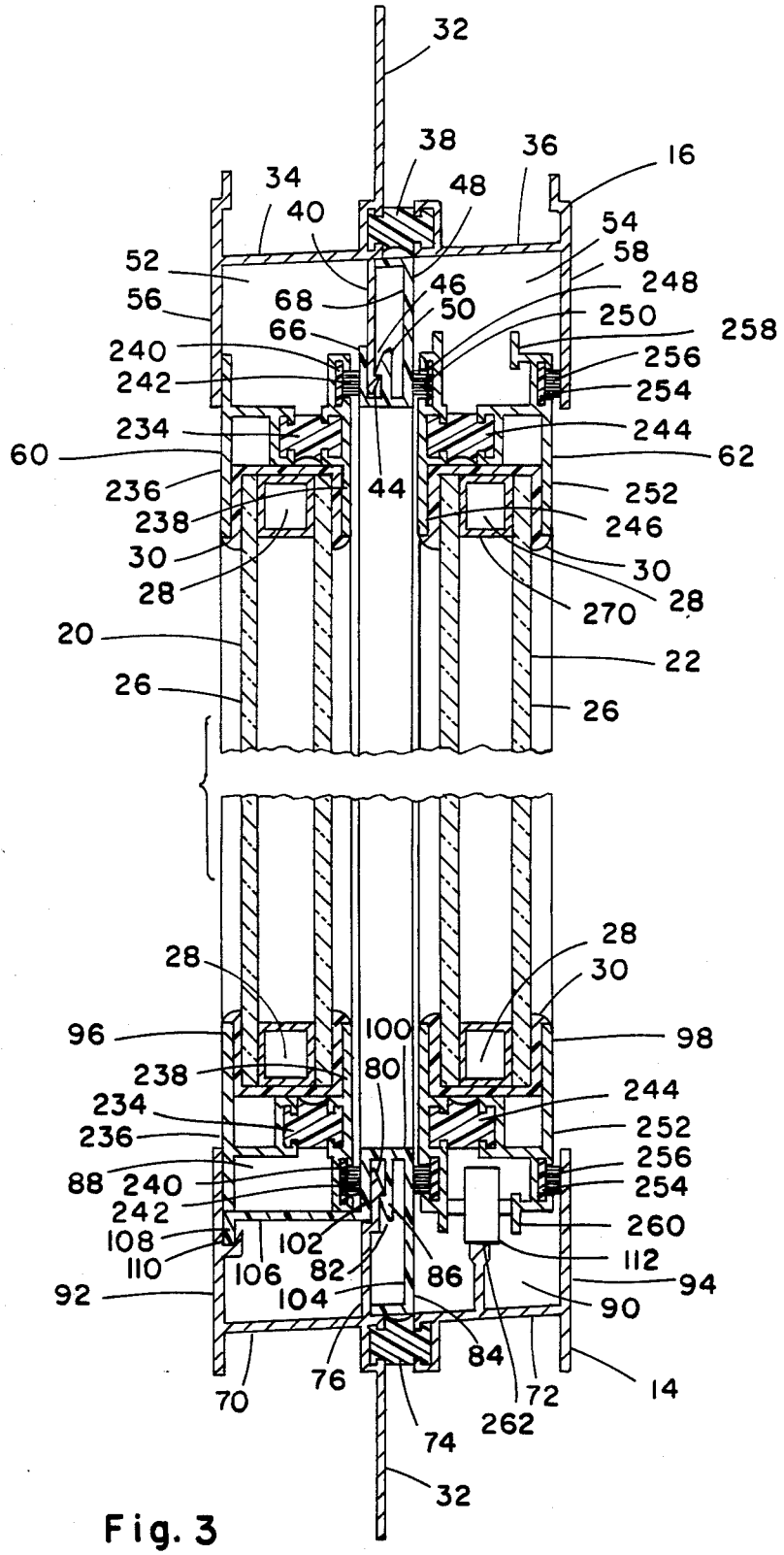
FIG. 3 is a cross-sectional view of the left half of the window of FIG. 2, with a section taken on line 3—3 of FIG. 2.
Figure 6:
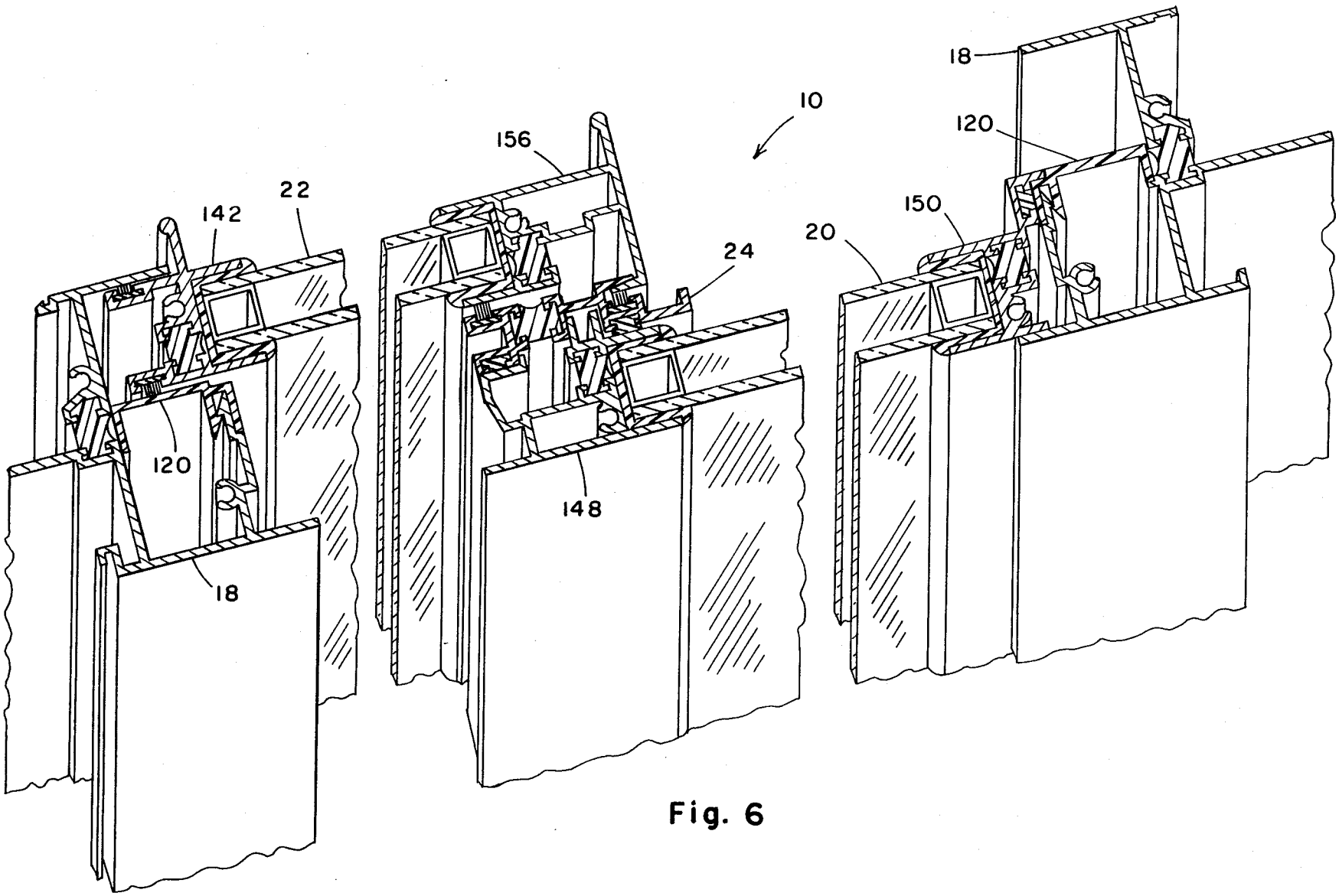
FIG. 6 is an isometric view of the bottom half of the window of FIG. 1, with a section taken along line 2—2 of FIG. 1.
Figure 7:
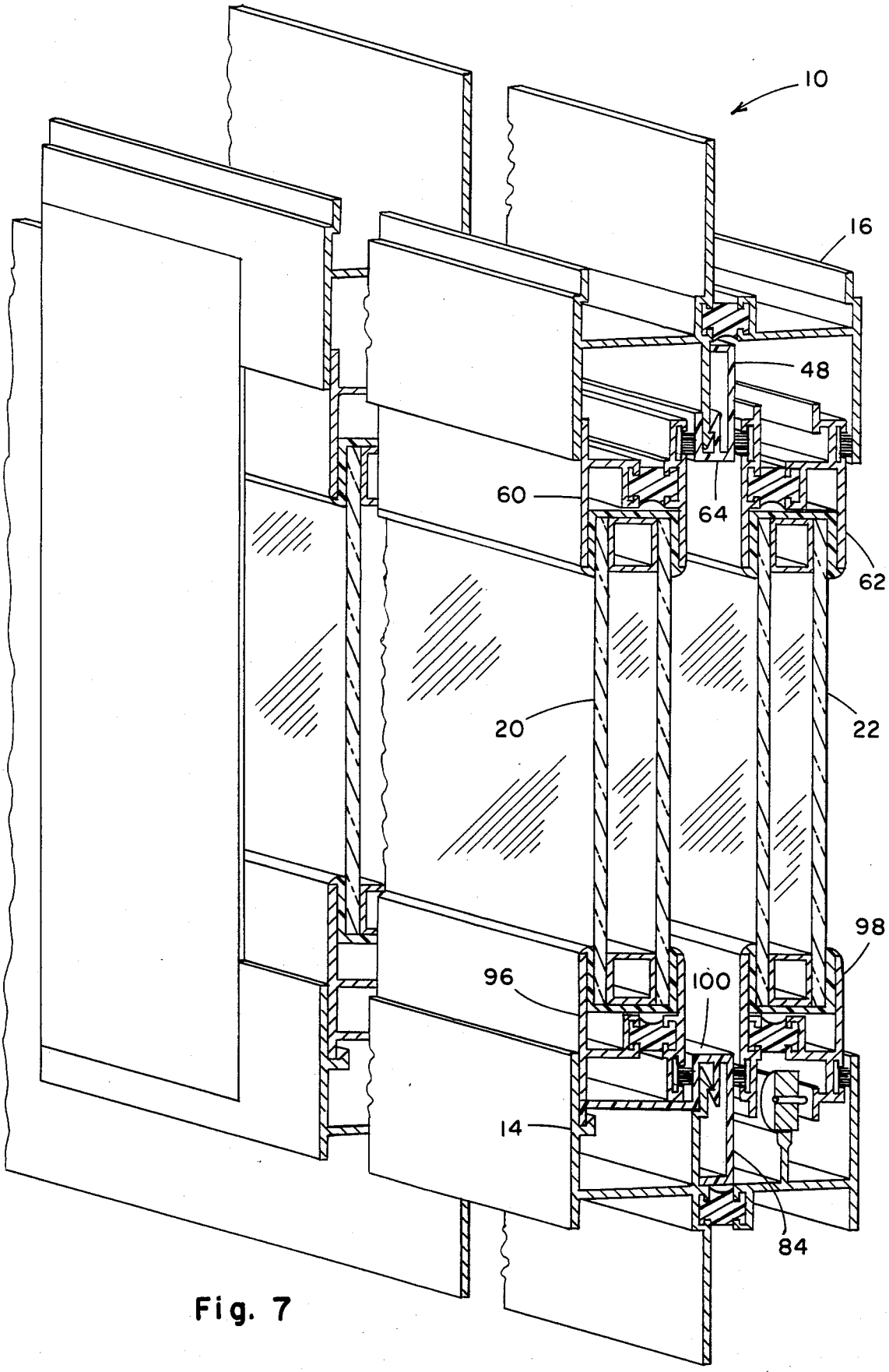
FIG. 7 is an isometric view of the left half of the window of FIG. 2, with a section taken on line 3—3 of FIG. 2.

The fixed sash jamb 150 is affixed against the T-section 136 and the frame jamb parting-vinyl rigid strip 120 on the right jamb 18 of FIG. 2.

The fixed sash meeting rail 148 has an inwardly opening screw receiving channel 152 on the inner side. The intermediate interlock rail 24 is disposed against the inner side of the fixed sash meeting rail 148, and is removably affixed thereto by two or more screws 154, depending on the height of window 10.

The vent sash meeting rail 156, when the vent sash 22 is closed, is disposed against and interengaged with the inner side of the intermediate interlock rail 24.

Figure 4:
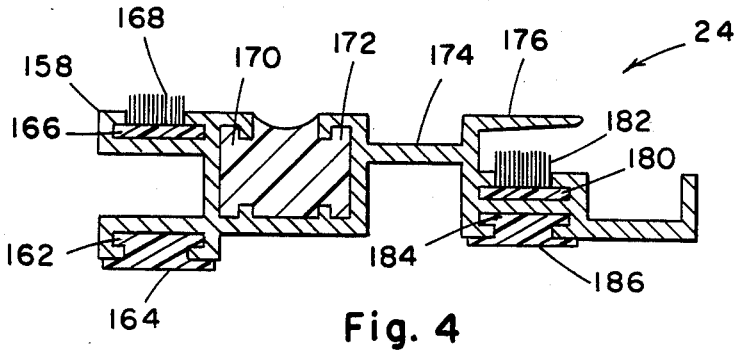
FIG. 4 is an end view of the aluminum extrusion used to form the intermediate interlock rail, prior to removal of the channel metal base.
Figure 5:
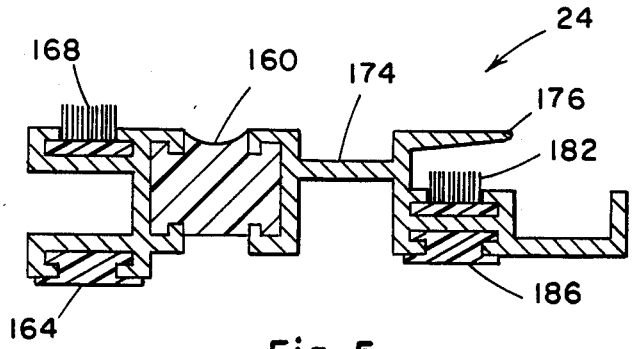
FIG. 5 is an end view of the intermediate interlock rail, in final usable form.

The intermediate interlock rail 24 is a single element which extends vertically with the bottom resting on the flat top wall 100 of the elongate frame sill parting-vinyl rigid strip 84 and the top abutting against the flat bottom wall 64 of the elongate frame head parting-vinyl rigid strip 48. As manufactured, the intermediate interlock rail 24 is a single aluminum extrusion 158, seen in FIG. 4, which includes a channel portion which is filled with molten polyurethane, which hardens in place, followed by removal of the metal base of the channel, forming a thermal break 160, seen in FIG. 5.

The thermal breaks 38, 74 and 118, and other thermal breaks shown, were also formed by this known "fill and debridge" system. The thermal breaks will be seen to, in all instances, bond together two non-metallically connected portions of an element, specifically, an outer cold section and an inner warm section.

The intermediate interlock rail 24 includes, in its outer cold section an outwardly directed channel 162 out of which extends a vinyl weatherstrip 164 for sealingly engaging the outer cold section of the fixed sash meeting rail 148, an inwardly directed channel 166 out of which extends a pile weatherstrip 168 for sealingly engaging the outer cold section of the vent sash meeting rail 156, and a sidewardly directed channel 170 which contains a portion of the thermal break 160.

The intermediate interlock rail 24 includes in its inner warm section a sidewardly directed channel 172, a flat wall section 174 through which screws 154 extend, a sidewardly directed bevelled flange 176 for engaging a complementarily disposed bevelled flange 178 on the vent sash meeting rail 156 when the vent sash 22 is closed, an inwardly directed channel 180 out of which extends a pile weatherstrip 182 for sealingly engaging the bevelled flange 178, an outwardly directed channel 184 out of which extends a vinyl weatherstrip 186 for sealingly engaging the inner warm section of fixed sash meeting rail 148, and a sidewardly and inwardly directed L-shaped flange for receiving and holding a window lock arm 188.

The vent sash meeting rail 156 includes in its left side a channel 28 formed in part by inner warm section elements and in part by outer cold section elements, with a thermal break 190 in between. The inner warm section also includes, on the right side, a flat wall 192 on which the window lock 194 is rotatably mounted, and between wall 192 and channel 28 a pair of connecting ribs 196, 198. Bevelled flange 178 extends leftward from the outer end of flat wall 192 and a finger grasping bead 200 is formed on the inner end of flat wall 192.

The fixed sash meeting rail 148 includes in its right side a channel 28 formed in part by inner warm section elements and in part by outer cold section elements, with a thermal break 202 in between. The inner warm section also includes screw receiving channel 152. The outer cold section also includes the shallow channel 146, and between channel 28 and channel 146 a pair of connecting ribs 204, 206. The outer connecting rib 206, along with elements forming the outer wall of channels 28 and 146 form a continuous flat outer wall on meeting rail 148. Extending inward from channel 146 is an L-shaped flange 208, the inner part of which is sealingly engaged by vinyl weatherstrip 164.

The fixed sash jamb 150 includes in its left side a channel 28 formed in part by inner warm section elements and in part by outer cold section elements, with a thermal break 210 in between. The outer cold section also includes a sideward flange 212 for disposition against the inner face of the adjacent T-section 136. The inner warm section also includes an inwardly directed flange 214 with a sidewardly directed channel 216 out of which extends a vinyl weatherstrip 218 for sealingly engaging the outwardly directed short flange 126 of rigid strip 120.

The fixed sash jamb 150 is removably affixed to the elongate frame jamb parting-vinyl rigid strip 120 and to the base stem 134 of T-section 136 of the right vertical jamb member 18 by means of screws (not shown) which extend through the inwardly directed flange 214 and into the short flange 126 and the base stem 134.

The vent sash jamb 142 includes in its right side a channel 28 formed in part by inner warm section elements and in part by outer cold section elements, with a thermal break 220 in between. The outer cold section also includes a sidewardly directed flange 222 with an outwardly directed channel 224 out of which extends a pile weatherstrip for sealingly engaging rigid strip 120 when the inner vent sash is closed. The inner warm section also includes a sidewardly directed flange 226 with an inwardly directed channel 228 out of which extends a pile weatherstrip for sealingly engaging outer wall 140 when the inner vent sash is closed, and also an inwardly directed flange 230 with a finger grasping bead 232 at the inner end.

The fixed sash top and bottom members 60 and 96 each include a channel 28 formed in part by inner warm section elements and in part by outer cold section elements, with a thermal break 234 in between. The outer cold section also includes a vertical flange 236 for abutting outer walls 56 and 92. The inner warm section also includes a vertical flange 238 with an inwardly directed channel 240 out of which extends a pile weatherstrip 242 for sealingly engaging rigid strips 48 and 84.

The vent sash top and bottom members 62 and 98 each include a channel 28 formed in part by inner warm section elements and in part by outer cold section elements, with a thermal break 244 in between. The outer cold section also includes a vertical flange 246 with an outwardly directed channel 248 out of which extends a pile weatherstrip 250 for sealingly engaging rigid strips 48 and 84. The inner warm section also includes a vertical flange 252 with an inwardly directed channel 254 out of which extends a pile weatherstrip 256 for sealingly engaging outer walls 58 and 94.

The vent sash top and bottom members 62 and 98 also have roller assembly guide flanges 258, 260, functional only in the bottom member 98 for supporting roller assemblies 112, as the roller assemblies roll sideways on a raised roller path 262 in channel 90.

In order to remove the two sashes 20 and 22, the vent sash 22 is moved to a partly open position, raised slightly, the bottom edge is swung inwardly, and the sash 22 is lowered out of the upper channel 54. The screws 154 are removed from the intermediate interlock rail 24 and the interlock rail 24 is removed to the inside. The screws (not shown) in the inwardly directed flange 214 of the fixed sash jamb 150 are removed, and the fixed sash 20 is raised slightly, the bottom edge tilted inwardly and the sash 20 is lowered out of the upper channel 52.

In order for the fixed outer sash 20 and the slidable inner sash 22 to be able to fit between the sill member 14 and the head member 16, it is necessary to form notches at the top and bottom of the sash vertical members in portions which extend into the central portion occupied by the rigid strips 48 and 84. In order for the sashes 20 and 22 to be removable, it is necessary to extend such notches downward an additional extent equal at least to the distance which the sashes must be raised into the upper channels when removing the sashes. This is of particular significance, in horizontally disposed windows, at the vertical meeting rail, and in prior horizontally disposed removable windows there has been a small gap produced at the top of the meeting rails through which cold outside air could get through, or warm inside air get out.

In the present invention, the fixed sash meeting rail 148 has an inwardly opening screw receiving channel 152 on the inner side, formed by two inwardly directed parallel elongate flanges 264, 266. Flanges 264, 266 are notched at the bottom sufficient to extend down only to the flat top wall 100 on rigid strip 84, when the fixed sash 20 is in its normal position. At the top, flanges 264, 266 are cut down in height a distance sufficient to fit under the flat bottom wall 64 of rigid strip 48 plus an additional distance equal to at least the distance which the fixed sash 20 must be raised into channel 52 during removal.

The inner vent sash meeting rail 156 has a complementary bevelled flange 178 which must be cut shorter than the other portions of rail 156, both at the bottom and the top, to fit over rigid strip 84 at the bottom and under the rigid strip 48 at the top, plus the additional distance at the top necessary to raise the inner sash 22 during removal.

These additional cutbacks at the top of the above-described elements, to permit raising sash 20, 22 during removal do not result in a passageway through which outside air can get in or inside air can get out, due to the presence of the intermediate interlock rail 24.

As has been described above, the intermediate interlock rail 24 provides a complete closure from top to bottom extending from fixed outer sash 20 to slidable inner sash 22, including a thermal break 160, pile weatherstripping 168 and vinyl weatherstripping 164 and 186. Intermediate interlocking rail 24 has all elements extending the full height between the rigid strip flat bottom wall 64 and the rigid strip flat top wall 100, since the removal of intermediate interlock rail 24 does not involve any raising or lowering steps.

Also shown in the drawings are a plurality of elongate C-shaped screw receiving channels 268 for screw attachment of horizontal elements to the vertical elements, as is understood in the art. Between the two sheets of glass in each pair 26 are square tubes 270 filled with a desiccant, for avoiding condensation on the inner surfaces of the glass, as is known in the art.

Having completed a detailed disclosure of the preferred embodiment of my invention so that those skilled in the art may practice the same, I contemplate that variations may be made without departing from the essence of the invention or the scope of the appended claims.

I claim:

1. A horizontal sliding window comprising a frame sill member, a frame head member and at least two removable, normally side by side, spaced, parallel sashes, said two sashes being mounted in parallel channels in said frame sill member and said frame head member, said frame sill member and said frame head member each having a rigid strip disposed therein which separates said parallel channels in said frame members, said two sashes being removable from respective channels in said frame members by raising of the said sashes out of said frame sill member channels and further up into said frame head member channels followed by tilting of said sashes and lowering of said sashes out of said frame head member channels, said window further comprising an intermediate interlock rail disposed in a plane between said spaced parallel sashes, said interlock rail sealingly engaging two spaced parallel sashes when said two sashes are in normal, side by side positions, said interlock rail having sealing elements on two opposed sides which sealingly engage said two sashes in a sealing relationship which extends completely from said rigid strip in said frame sill member to said rigid strip in said frame head member.

2. A horizontal sliding window as defined in claim 1 wherein at least one of said sashes is mounted on means disposed in a sill member channel for permitting ease of sliding said sash in a horizontal direction.

3. A horizontal sliding window as defined in claim 1 wherein said sashes include at least one sliding sash and at least one fixed sash.

4. A horizontal sliding window as defined in claim 1 wherein said intermediate interlock rail, said frame sill member, said frame head member and the outer portions of said sashes are formed primarily from aluminum extrusions.

5. A horizontal sliding window as defined in claim 4 wherein said rail, said frame sill member, said frame head member and said outer portions of said sashes are formed from single aluminum extrusions which have been divided into two portions connected by a plastic thermal break.

6. A horizontal sliding window as defined in claim 5 wherein said sashes each contain dual parallel glass sheets.

7. A horizontal sliding window as defined in claim 6 wherein said dual glass sheets are mounted in vinyl plastic glazing strips, which are mounted in inwardly opening channels in said sashes.

8. A sliding window as defined in claim 1 wherein said frame sill member and said frame head member each contain an elongate central rigid plastic strip.

9. A sliding window as defined in claim 8 wherein said rigid plastic strips are lockingly engaged and held in said respective sill and head members.

10. A sliding window as defined in claim 1 wherein said frame sill member and said frame head member each contain an elongate central rigid strip each having an innermost surface engaging respectively the bottom and the top ends of said intermediate interlock rail.

11. A sliding window as defined in claim 10, wherein said innermost surfaces on said rigid strips are each flat surfaces.

12. A sliding window as defined in claim 11 wherein said flat surface portions of said rigid strips connect flanges which form the central walls of the parallel channels in said frame sill and head members.

13. A sliding window as defined in claim 10 wherein said frame sill member and said frame head member are adjoined at each side of said window by a frame vertical jamb member, each containing a centrally disposed rigid strip.

14. A sliding window as defined in claim 13 wherein said rigid strips in said frame sill member, said frame head member and said frame vertical jamb members are formed of a rigid plastic, forming a non-metallic central wall for the channels for said sashes.

15. A sliding window as defined in claim 1 wherein said intermediate interlock rail is screw attached to a vertical meeting rail of a fixed sash.

16. A sliding window as defined in claim 15 wherein said fixed sash is an outer sash and has an inwardly opening screw receiving channel on said fixed sash vertical meeting rail into which screws are attached to affix said intermediate interlock rail.

17. A sliding window as defined in claim 16 wherein said inwardly opening screw receiving channel is notched at the bottom and the top to fit between said rigid strips in said frame sill and head members, said notch at the top being spaced from said head member rigid strip to permit raising said fixed sash during removal of said fixed sash.

18. A sliding window as defined in claim 17 wherein said intermediate interlock rail has all portions extending the full height of the space between said rigid strips in said frame sill and head members.

19. A sliding window as defined in claim 1 wherein said sashes include at least one sliding sash, said sliding sash having a meeting rail which sealingly engages said intermediate interlock rail, said meeting rail and said intermediate interlock rail each having overlapping elongate complementary bevelled ramps which engage and seal when said sliding sash is closed.

20. A sliding window as defined in claim 19 wherein said bevelled ramp on said sliding sash is notched at the bottom and at the top to fit between said rigid strips in said frame sill and head members, said notch at the top being spaced from said head member rigid strip to permit raising said sliding sash during removal of said sliding sash.

* * * * *